United States Patent [19]

Gasbarro

[11] Patent Number: 4,912,777

[45] Date of Patent: Apr. 3, 1990

[54] DIVER'S SAFETY CAP

[76] Inventor: Tony J. Gasbarro, Apt. #6, 683 Churchill Avenue, Ottawa, Ontario, Canada, K1Z 5G4

[21] Appl. No.: 247,288

[22] Filed: Sep. 21, 1988

[51] Int. Cl.[4] ..... A63B 33/00

[52] U.S. Cl. ..... 2/2.1 R; 2/414; 2/423; 2/425; 2/431

[58] Field of Search ..... 2/2.1 R, 410, 411, 412, 2/414, 415, 423, 425, 431

[56] References Cited

U.S. PATENT DOCUMENTS

| | | | |
|---|---|---|---|
| 3,274,612 | 9/1966 | Merriam | 2/425 X |
| 3,296,582 | 1/1967 | Ide | 2/423 X |
| 3,588,914 | 6/1971 | Ihnat, Jr. | 2/425 X |
| 3,770,483 | 11/1973 | Komine | 2/410 X |
| 4,008,949 | 2/1977 | Luna | 2/410 X |
| 4,134,155 | 1/1979 | Robertson | 2/412 |
| 4,321,433 | 3/1982 | King | 2/414 X |
| 4,612,672 | 9/1986 | Schrack | 2/411 X |

FOREIGN PATENT DOCUMENTS

| | | | |
|---|---|---|---|
| 56883 | 8/1982 | European Pat. Off. | 2/425 |
| 3005133 | 8/1981 | Fed. Rep. of Germany | 2/425 |

*Primary Examiner*—Wm. Carter Reynolds
*Attorney, Agent, or Firm*—Burke-Robertson

[57] ABSTRACT

A safety cap is provided to be worn on the head of a diver such as a scuba diver or snorkelor, for protection against contusions, abrasions, incisions, lacerations and the like. The safety cap comprises an exterior, unitary shell of part-spherical configuration made of flexible plastic, to provide a smooth outer surface. The flexible plastic is of sufficient strength to resist small impact loads. A continuous interior liner of open cell foam is secured within the exterior shell to act as padding and to provide a thermally protective layer for the diver's head. A pair of straps are provided, each one being secured to a side of the shell. Each strap is of a length and provided with securing means respectively for looping and securing about a proximal portion of a head strap of diver's face mask or goggles when worn by the diver. The cap is easy to wear and provides significantly improved protection for divers against minor, low impact head injuries.

11 Claims, 1 Drawing Sheet

DIVER'S SAFETY CAP

BACKGROUND OF THE INVENTION

The present invention relates to a safety cap, and more particularly to a safety cap for protecting the head of a scuba diver or snorkelor against minor head injuries such as contusions, abrasions, incisions, lacerations and the like.

At the present time there are few, if any, devices available commercially for use by divers such as snorkelors and scuba divers, to protect them against minor head injuries. Head injuries are a major concern for such divers. Sites of underwater wrecks, caves, or the like, where they may be diving, may have sharp objects (nails, rocks, and the like) projecting outwardly. Current action may push a diver into contact with such protruding objects resulting in injury to the diver if the diver's head comes into contact with one of them.

Protective caps for persons engaged in athletic activities on land are well-known. Thus, football players and competitive bicycle riders conventionally wear protective helmets, each respectively designed for the respective sport. Such helmets are traditionally held on the head of the wearer by a strap extending from the helmet about the wearer's chin.

U.S. Pat. No. 4,134,155 of Robertson issued Jan. 16, 1979 describes and illustrates a protective helmet designed for military air crewmen who may be required to descend from an aircraft into the water to aid in recovery of an injured or disabled survivor. That helmet is designed to fully wrap around all but the face of the wearer, and is similar in this regard, in overall shape, to that of a standard helmet worn by air crew. The helmet however has a plurality of impact protective plates secured to a base of protective layers. The helmet is held in position by a conventional chin strap.

Canadian Patent No. 387,977 of Chambers issued Mar. 19, 1929 describes and illustrates a cap with goggles to be worn in an industrial environment, in which the goggles are pivotally supported on the cap.

Other patents of general background interest relating to protective helmets include Canadian Patents Nos. 1,189,459 of Braun issued June 25, 1985 and 1,196,249 of Warncke issued Nov. 5, 1985.

OBJECTS OF THE INVENTION

It is an object of the present invention to provide a protective cap or helmet for use by scuba divers, snorkelors and other such persons diving in water, to protect them against minor head injuries. It is another object of the present invention to provide a lightweight, durable, comfortable protective cap for divers which may be readily worn with conventional diver's equipment.

SUMMARY OF THE INVENTION

In accordance with the present invention there is provided a safety cap to be worn on the head of a diver such as a scuba diver or snorkelor, for protection against contusions, abrasions, incisions, lacerations and the like. The safety cap comprises an exterior, unitary shell of part-spherical configuration, made of flexible plastic, to provide a smooth outer surface. The flexible plastic is of sufficient strength to resist small impact loads. A continuous interior liner of open cell foam is secured within the exterior shell to act as padding and to provide a thermally protective layer for the diver's head. A pair of straps are provided, each one being secured to a side of the shell. Each strap is of a length and provided with securing means respectively for looping and securing about a proximal portion of a head strap of diver's face mask or goggles when worn by the diver.

In a preferred embodiment of the present invention each strap of the safety cap is provided with buckle means as the securing means. An end of the strap is looped about the proximal portion of the head strap of the face mask or goggles when in position about the diver's head, and that end is secured to the buckle means to secure the safety cap in place on the head of the diver.

The safety cap for divers in accordance with the present invention does not interfere with conventional scuba diving or snorkeling equipment used for breathing and seeing underwater, or other safety type devices used by divers. It is effective in protecting the forehead and crown areas of the diver's head, which would otherwise have been exposed, against injury from contact with sharp objects underwater. The safety cap in accordance with the present invention is easy to put on and easily adjustable.

BRIEF DESCRIPTION OF THE DRAWINGS

These and other objects and advantages of the invention will become apparent upon reading the following detailed description and upon referring to the drawings in which.

Figure 1:
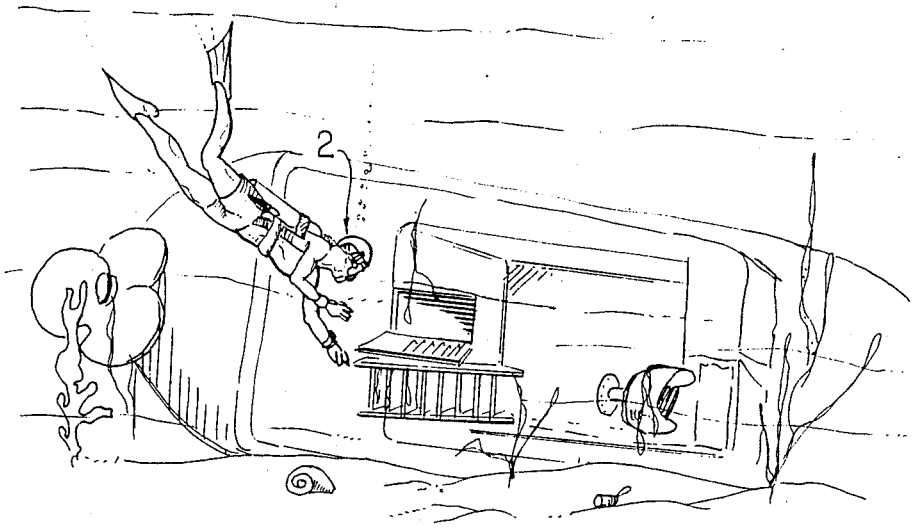
FIG. 1 is a perspective view of a safety cap for divers in accordance with the present invention in position on the head of a diver.

While the invention will be described in conjunction with an example embodiment, it will be understood that it is not intended to limit the invention to such embodiment. On the contrary, it is intended to cover all alternatives, modifications and equivalents as may be included within the spirit and scope of the invention as defined by the appended claims.

DETAILED DESCRIPTION OF THE INVENTION

In the drawings, similar features have been given similar reference numerals.

Figure 2:
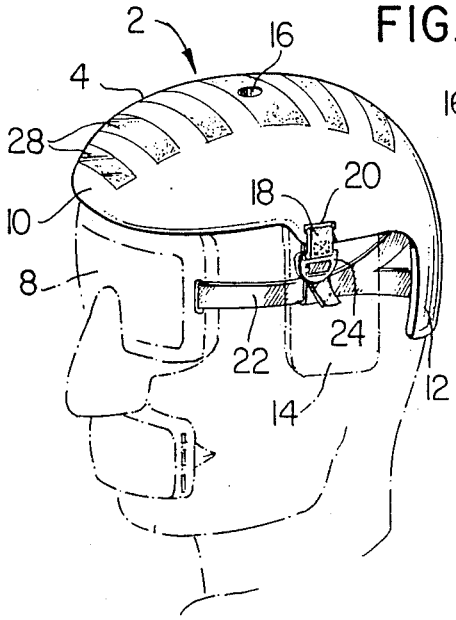
FIG. 2 is an enlarged perspective view of the cap of FIG. 1.

Turning to FIGS. 1 and 2, there is illustrated a safety cap 2 to be worn on the head of a diver, in accordance with the present invention, for protection against head injuries. The cap 2 comprises an outer shell 4 made of flexible plastic, providing a smooth outer surface. The outer shell 4 should be constructed having sufficient strength to resist small impact loads. Secured within outer shell 4 is a continuous interior liner 6 made for example of neoprene or any other open cell foam. Liner 6 acts as a padding and provides a thermally protective layer for the swimmer's head. As can be seen in FIG. 2, safety cap 2 when in position sits immediately above the goggles or face mask 8 and has a peripheral contour which provides protection of the forehead and crown areas of the diver's head. In this regard the edge of cap 2, when in position on a diver's head, extends from forward edge 10, immediately above mask or goggles 8, rearwardly to a downwardly extending neck-protecting flap 12 to be positioned at the base of the wearer's cranium. Optional flaps 14 to be located over the wearer's ears may be provided. Outer shell 4 is of integral construction, as is, preferably, liner 6. The construction of outer shell 4 in combination with liner 6 is preferably such that the two will provide buoyancy for the safety cap when attached, as will be described in more detail subsequently, to the strap of a face mask or goggles 8.

At the top of outer shell 4 is preferably provided a small air purge hole 16 for passage of air trapped within.

Figure 3:
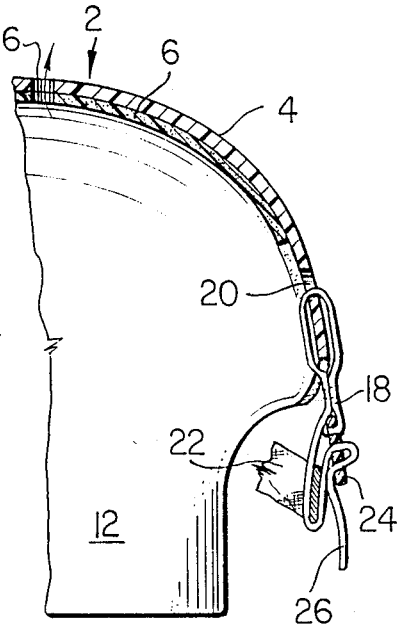
FIG. 3 is a partial section view, towards the rear, of the cap of FIG. 2.

Instead of a conventional neck strap, to hold safety cap 2 in position on a wearer's head, a pair of straps 18 are provided, one on each side of shell 4 and liner 6. Each strap 18 passes through a slot 20 in outer shell 4, as illustrated in FIG. 3, and looped about the adjacent strap 22 of face mask or goggles 8 when in position on the wearer's head, strap 22 extending from the face mask or goggles 8 along each side of the wearer's head and about the back thereof, to hold the face mask or goggles 8 in position on the wearer's face. Strap 18, thus looped about strap 22, is then secured in strap buckle 24 fixed to strap 18, as illustrated, by passing the free end 26 of strap 18 through buckle 24. Of course any other appropriate strap securing means may be provided in lieu of buckle 24.

The outer shell 4 of safety cap 2 may be of bright colouring, to assist others in the visual locating underwater of a diver wearing the safety cap. Alternatively, brightly coloured or fluorescent paint or tape 28 may be applied to the outer surface of outer shell 4 to achieve this end.

Safety cap 2 in accordance with the present invention is designed and constructed with several features in mind: it is lightweight, comfortable and attaches directly to the strap 22 of mask or goggles 8, making it easy to put on and remove. Because it is flexible, one size can be provided to fit almost all adult persons. Its individual straps 18 make it easy to adjust. It does not interfere with conventional scuba diving or snorkeling equipment and is extremely effective in protecting otherwise exposed areas of the wearer's head, as can be seen in FIGS. 1 and 2.

Thus it is apparent that there has been provided in accordance with the invention a diver's safety cap that fully satisfies the objects, aims and advantages set forth above. While the invention has been described in conjunction with a specific embodiment, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. A safety cap to be worn on the head of a diver such as a scuba diver or snorkelor, for protecting against minor head injuries such as contusions, abrasions, incisions, lacerations and the like, the safety cap comprising an exterior, unitary shell of part-spherical configuration made of flexible plastic, to provide a smooth outer surface, the flexible plastic being of sufficient strength to resist small impact loads, and a continuous interior liner of open cell foam, the liner secured within the exterior shell to act as padding and to provide a thermally protective layer for the diver's head, and a pair of straps, one secured to each side of the shell, each strap being of a length and provided with securing means respectively for looping and securing about a proximal portion of a head strap of diver's face mask or goggles when worn by the diver.

2. A cap according to claim 1 wherein the securing means of each strap is a buckle means, an end of the strap to be looped about the proximal portion of the head strap of the face mask or goggles when in position about the diver's head, and secured to the buckle means to secure the safety cap in place on the head of the diver.

3. A cap according to claim 1 wherein a small hole is provided in the top of the cap for passage of air trapped within during use.

4. A cap according to claim 1 wherein the shell comprises portions on either side downwardly extending to cover and protect a wearer's ears, when the cap is in position on a wearers' head.

5. A cap according to claim 1 further provided with a downward extension at its rear to cover and protect the lower rear head portion of a wearer when in position on a wearer's head.

6. A cap according to claim 2 wherein a small hole is provided in the top of the cap for passage of air trapped within during use.

7. A cap according to claim 6 further provided with a downward extension at its rear to cover and protect the lower rear head portion of a wearer when in position on a wearer's head.

8. A cap according to claim 1 wherein the interior liner is made of neoprene.

9. A cap according to claim 1 wherein the shell has a peripheral contour, when in position on a diver's head, which extends from immediately above where the diver's mask or goggles would normally sit, rearwardly to end at a downward extension to be normally positioned at the base of the wearer's cranium.

10. A cap according to claim 1 wherein the exterior shell and liner are made so as to have, in combination with a diver's mask, positive buoyancy.

11. A cap according to claim 1 further provided with bright coloured markings on the exterior shell to facilitate visibility of the cap in water.

* * * * *